United States Patent [19]

Koponen et al.

[11] Patent Number: 4,744,866

[45] Date of Patent: May 17, 1988

[54] WEB-FORMING METHOD IN A PAPER MACHINE

[75] Inventors: Martti Koponen; Martti Pullinen; Erkki Koski; Jouni Koskimies, all of Jyväskylä, Finland

[73] Assignee: Valmet Oy, Finland

[21] Appl. No.: 840,534

[22] Filed: Mar. 17, 1986

Related U.S. Application Data

[60] Division of Ser. No. 575,543, Jan. 31, 1984, Pat. No. 4,614,566, which is a continuation-in-part of Ser. No. 430,231, Sep. 29, 1982, abandoned.

[30] Foreign Application Priority Data

Mar. 2, 1982 [FI] Finland ..... 820742

[51] Int. Cl.[4] ..... D21F 1/00; D21F 1/40

[52] U.S. Cl. ..... 162/203; 162/208

[58] Field of Search ..... 162/300, 301, 302, 305, 162/306, 203, 208, 312, 352

[56] References Cited

U.S. PATENT DOCUMENTS 4,417,950 11/1983 Bubik et al. ..... 162/300

4,472,244 9/1984 Haltsonen ..... 162/300

*Primary Examiner*—Steve Alvo

*Attorney, Agent, or Firm*—Steinberg & Raskin

[57] ABSTRACT

A web-forming method is applied in a paper machine. The web-forming section which includes a lower wire loop having an initial single-wire run and dewatering zone in which the web is dewatered through and an upper wire loop having a joint run with a subsequent run of the lower wire to form a two-wire dewatering zone within which dewatering takes place substantially through the upper wire. A first open faced forming roll is situated within the upper wire loop so that the two-wire dewatering progress begins upwardly in the region of the first forming roll. A forming shoe within the lower wire loop has a curved deck whose center of curvature is situated on the side of the lower wire loop and further guides the joint run of the upper and lower wires in the two-wire dewatering zone. A second forming roll situated within the lower wire loop after the forming shoe guides the joint run of the upper and lower wires over a downwardly curved sector thereof. According to the method, initial dewatering occurs in the single-wire dewatering zone through the lower wire. In the two-wire dewatering zone, within the range of the first and second forming rolls and the forming shoe situated therebetween, dewatering occurs first within the sector of the first open forming roll in two directions through both the upper and lower wires and primarily through the upper wire. The web is thus substantially dewatered whereupon within the region of the forming shoe, further dewatering takes place primarily upwardly through the upper wire and thereupon the dewatering pressure is further increased within the range of the second forming roll while dewatering continues to take place substantially through the upper wire.

11 Claims, 5 Drawing Sheets

FIG. 3
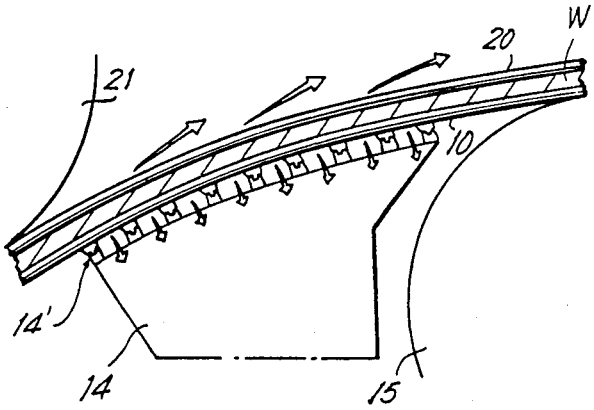
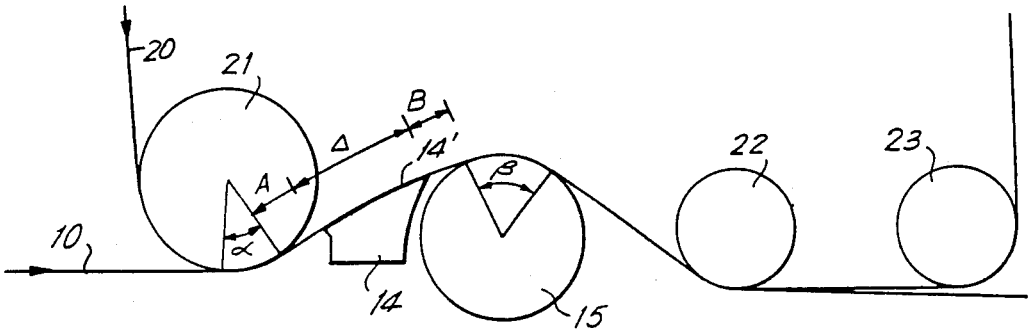
FIG. 4

FIG. 6a
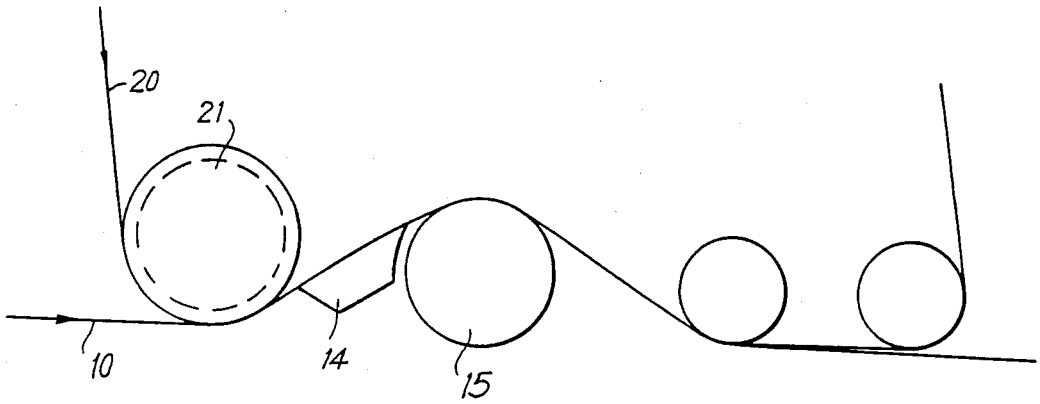
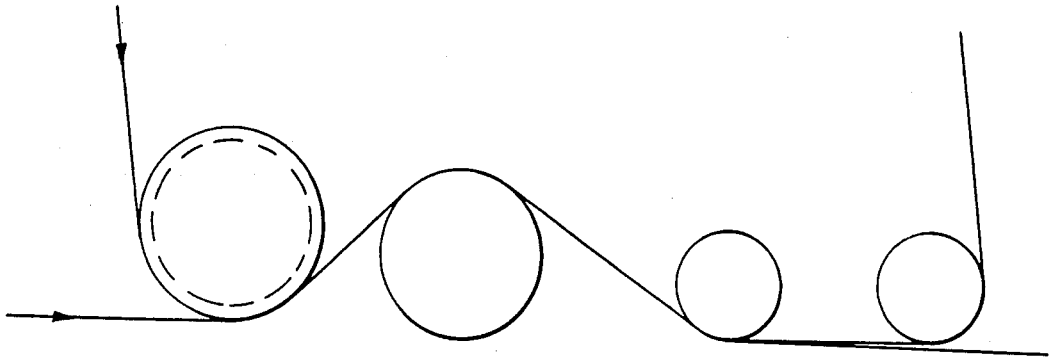
FIG. 6b

WEB-FORMING METHOD IN A PAPER MACHINE

This is a division of application Ser. No. 575,543 filed Jan. 31, 1984, now U.S. Pat. No. 4,614,566 which is a continuation-in-part of Ser. No. 430,231 filed Sept. 29, 1982 now abandoned.

BACKGROUND OF THE INVENTION

The present invention relates generally to methods applied in web-forming sections of paper machines.

Specifically, the present invention is directed to a web forming and dewatering method applied in web-forming section which comprises a lower-wire loop situated in proximity to a headbox of the paper machine so as to form an initial, preferably substantially horizontal, single wire run and zone in which the dilute fiber suspension constituting the web-forming stock is dewatered through said lower wire by dewatering means, the web-forming section also comprising an upper wire loop guided by guide and/or web-forming rolls and having a joint run with a subsequent run of the lower wire so as to form a two-wire dewatering zone within which dewatering of the web takes place substantially upwardly through the upper wire.

Fillers, normally constituted by mineral substances, are often incorporated within paper mainly in order to improve the and printability properties of the paper. As is well known, the addition of fillers can be accomplished in two ways, i.e., either as a filling into the pulp stock or by means of coating. In the former procedure, the filler is added into the pulp as a sludge before the pulp arrives at the paper machine so that the filler is present in the ready paper mixed in the entire fiber material. In the latter procedure, an appropriate sizing agent, i.e., starch or caseine, is mixed with the filler in a water phase, whereupon the surface of the paper is coated with the mixture.

The fillers are usually added into the fiber stock in the form of a water sludge. The addition of the fillers takes place, e.g., into the pulper, grinders, or proximate to the headbox of the machine, into an appropriate pulp chest or onto the inlet side of the headbox feeding pump. Fillers are used most commonly for printing papers, for improving their opacity, whiteness, ink-absorption, and smoothness. Moreover, fillers have a particularly favorable effect on the quality of paper to be glazed.

However, fillers do not adhere well to the fiber themselves of the stock which is a main reason for the poor retention of fillers in the ready paper. For this reason the filtering effect of the fiber network which withholds the filler particles becomes an important factor affecting the retention of the fillers. The degree of filtering effect provided by the fiber network is determined by the thickness of the fiber web running on the wire, by the density of the fiber network, by the mesh of the wire and, moreover, by the draining or dewatering effects applied to the web. The grinding, which fibrillates the fibers, improves the retention of fillers by promoting the formation of the fiber network and thus the adhesion of the fillers to the fibers.

The retention is also affected by the physical properties of the filler particles, such as their size, shape and density. Larger particles are filtered better than smaller ones which are readily carried through the filtering fiber layer. Heavier particles are filtered to a lesser extent than lighter ones.

Like all the fine materials in paper, such as fine fibers and coloring agents, fillers tend to be unevenly distributed across the thickness of the paper thereby causing a so-called two-sidedness in the paper which means that the two sides of the paper have different surface properties. The two-sidedness of paper manufactured in the fourdrinier machines results from the fact that the fillers are washed away from the lower portion of the fiber web along with the drained water whereby the top portion of the web becomes enriched in fillers relative to the bottom portion of the web.

As is well known, attempts have been made to relieve the problems of two-sidedness of paper, not only by means of additives improving the retention of the fillers in the fiber network, but also by performing the dewatering during the initial filtering stage gently which requires a prolonged draining time and, consequently, either a lengthening of the wire section or reduction in the speed of the paper machine.

In the case of fourdrinier machines, the difficulties of distribution of fines and fillers are encountered in the manufacture of papers for offset printing. A high content of fillers and fines in the upper face of the paper causes dusting, which is a serious drawback in the offset process. On the other hand, papers manufactured by means of twin or two wire machines are considered well suited for offset printing due to the symmetric distribution of fines within the paper which is a result of the substantially equal washing of both faces of the web during the two-sided dewatering. Thus, it is recognized that due to the more uniform distribution of fines, offset printing on paper manufactured by means of a twin-wire method is more successful than printing on paper manufactured by means of a fourdrinier machine. The quality of offset printing is becoming increasingly important since the letter-press printing method is being increasingly replaced by offset printing.

On the other hand in a twin-wire former, the filler content of the faces of the paper web cannot in all cases be brought to the desired level and when fourdrinier wire sections are used, only the upper side of the paper web, i.e., the side facing away from the wire, will have a satisfactory filler content. An unduly low filler content of the web faces is particularly problematical in the case of super calendered gravure printing papers. Although attempts have been made to increase the filler content of the paper faces by increasing the filler content of the stock in the headbox, such attempts have not proved entirely satisfactory due to the typically poor retention of the fillers as discussed above and the enriched amount of fillers in the interior of the paper. Moreover, consistency of the stock in the headbox becomes easily excessive which deteriorates the formation of paper.

In conventional twin-wire formers, or so-called full-gap formers, which are now in common use, the stock is supplied into the wire section as a thin suspension whereupon a violet dewatering of the stock in both direction begins immediately or after a very short single-wire section, the result of this is that a considerable quantity of filler agents which have been added to the pulp, as well as fine fibers are washied away from the web along with the water being drained therefrom. Of course, this results in a considerable deterioration in the quality of the paper and, in particular, impairs the very properties intended to be provided to the paper by means of the fillers. Moreover, a dewatering takes place simultaneously in two directions also results in a weakening of the mid-portion of the paper web which in turn results in a low internal bond strength.

In a two-wire former which is disclosed in Finnish Pat. No. 50,648, assigned to applicants' assignee, a dewatering process is applied to avoid the drawbacks discussed above. This two-wire former is characterized by a single-wire initial portion of the wire part which is sufficiently long so that while a gentle dewatering takes place in the initial portion, the fiber web has time to obtain such a degree of felting prior to a two-wire portion of the wire part that the fibers can no longer be significantly shifted with respect to each other. Moreover, the two-wire portion of the wire part is guided, by means of a draining roll or by a draining box, so as to be curved downwardly whereby water is drained by the effects of centrifugal force and of the pressure zone produced by the tensioning between wires in the curved portion through the upper wire in a direction opposite to the direction of dewatering taking place in the single-wire initial portion. The main objective is to reduce the removal of additives, such as fillers, and fines from the fiber web and to increase the internal bond strength of the paper being manufactured.

It is well-known that in a conventional fourdrinier wire section, dewatering of the web is arranged to take place only in the downward direction so that fines and filler agents escape due to the washing effect of the foils or table rolls from that side of the web which faces the wire. For this reason a paper web manufactured in such a fourdrinier machine is anisotropic in regard to the surface properties of its two sides, the upper side of the web being smoother and containing more fines and fillers than the lower or wire side. Moreover, the wire side of the web is left with a mark from the wire.

For the above reasons, paper made by means of two-wire formers is considered superior, especially with respect to printing properties compared to paper made on fourdrinier wire sections. In such prior art two-wire formers in which no stationary dewatering elements are utilized, formation is usually poor and no pulsations of the dewatering pressure can be produced which would improve the formation. Another drawback of such prior art formers is that the same are provided with means for adjusting the ratio of the quantities of water being dewatered through the upper and the lower wire. The desirability of providing the capability for such an adjustment has been expressed on several occasions.

Two-wire formers are also known in the art wherein the dewatering is mainly effected by stationary dewatering elements. However, in such prior art two-wire formers a drawback is present in that filler and fine retention is relatively poor whereas wire wear and power consumption is high.

Recently, modernizations of fourdrinier wire sections have become common in which one or more upper-wire units are assembled above the fourdrinier wire section so as to render possible an upward dewatering from the web with the objective of both increasing the dewatering capacity as well as improving web formation and retention of fillers and fines. An increased dewatering capacity in turn permits an increase in the speed of the paper machine. A further aim of such modernized fourdrinier wire sections is to provide the capability of reducing the consistency of the stock supplied from the headbox which itself is advantageous. In certain cases, old low-speed newsprint machines have beer converted or modernized into board machines which produce thick paper and board grades requiring a high dewatering capacity without increasing the speed of the machine.

As examples of prior art arrangements of the type described above, reference is made to Finnish Patent Application No. 78 2709 (Beloit Walmsley Ltd.) and to British Pat. No. 1,582,342 (Australian Manufacturers Ltd. and Beloit Walmsley Ltd.). Reference is also made to U.S. Pat. No. 4,154,645 and to Finnish Patent Application Nos. 81 0373 and 81 1514, all assigned to applicants' assignee.

With respect to the prior art technology related to the present invention, reference is further made to published Swedish Patent Application No. 308,244 and Finnish Pat. No. 40,436.

A web-forming section including an initial single-wire dewatering zone followed by a two-wire dewatering zone may be designated a "hybrid" former. Hybrid formers are disclosed in U.S. Pat. Nos. 3,846,233; 4,154,645; 4,220,502; and 3,994,774.

SUMMARY OF THE INVENTION

Accordingly, it is a general object of the present invention to provide a new and improved web-forming method applicable in a wire wherein, dewatering is caused to take place, first downwardly in a relatively gentle manner in accordance with the principles disclosed in said Finnish Pat. No. 50,648, in a single-wire dewatering zone and after that a two-wire dewatering zone where dewatering is caused to take place substantially upwardly.

It is a particular object of the present invention to provide a new and improved web-forming method by means of which an improved formation of the web is achieved.

Another object of the present invention is to provide a new and improved web-forming method which allows an adjustment of the ratio of the quantities of water being expelled through the upper and lower wires thus making it possible to adjust the distribution of fillers and fines in the web so as to reduce the surface anisotropy of the web being formed. In accordance with this object, the method makes it possible to control the amount of downward dewatering takes place within the initial single-wire dewatering zone over wider limits than has been possible by previous methods to thereby allow in the subsequent two-wire dewatering zone a sufficiently large proportion of the total dewatering to take place in the upward direction through the upper wire, to thereby reduce the anisotropic characteristics of the web surfaces.

Still another object of the present invention is to provide a new and improved web-forming method which provides more efficient dewatering, of the web, primarily due to a relatively longer active dewatering zone.

A further object of the present invention is to provide a new and improved web-forming method which provides better retention of the fillers and fines within the fiber stock. Such retention has been particularly poor in prior art gap formers, especially in those in which stationary dewatering elements are mainly used. Good retention contributes, among other things, to reduction in energy costs and the elimination of the need for increasing the capacity of the headbox which would be otherwise necessary in the case of poor retention.

A further object of the invention is to provide a new and improved web-forming method which allows, if necessary, up to 50 percent of the water to be drained upwardly through the upper wire.

A still further object of the present invention is to provide a new and improved web-forming method wherein an improved support and stability of the wire runs within the two-wire dewatering zone is obtained. In this manner web formation is improved and streaks caused by the wire corrugations which would result from an unstable running of the wires are reduced.

Another particular object of the present invention is to provide a new and improved web-forming method which results in a high dry-matter content of the web so that it is possible to either entirely dispense with the use of dry suction boxes or reduce the number of such dry suction boxes thereby making it possible to reduce the power consumption of the forming section and reduce the wear of the wires.

Briefly, in accordance with the present invention, these and other objects are attained by providing a web-forming method wherein the stock coming from the headbox is initially predrained downwardly in a single-wire dewatering zone to facilitate retention of fines and fillers in the web initially formed thereon, followed by a first bidirectional, but predominantly upwards directed dewatering of the web at a first forming or dewatering phase roll situated in the region where the upper and lower wires are arranged to converge to form a two-wire dewatering zone, wherein dewatering of the web is caused to take place substantially upwards on a curved forming shoe and further at a second forming roll.

The web forming method in accordance with the invention, is applied in a so-called hybrid wire section comprising a lower wire loop having an initial single-wire run, defining a substantially horizontal dewatering zone within which the dilute fiber suspension constituting the web-forming stock is initially dewatered downwardly for initially forming a fiber network which promotes retention of fillers and fines as the web is subsequently dewatered in a two-wire dewatering zone which is defined by an upper wire together with a subsequent part of the lower wire loop to form a joint run within which the initially formed web is dewatered substantially upwardly. According to the invention, (a) a first dewatering forming roll having an open face is situated inside the loop of the upper wire, the two-wire forming zone beginning in the region of the first dewatering forming roll in which the two-wire dewatering zone is curved upwardly over a sector of the first dewatering forming roll for bidirectionally and predominantly upwardly dewatering the initially downwardly dewatered web through both the upper and lower wires, (b) a forming shoe situated closely after the first open dewatering forming roll in the direction of web travel within the two-wire dewatering zone and fitted within the loop of the lower wire, the forming shoe having a curved cover structure or deck guiding the joint upper and lower wire runs to dewater the web predominantly upwardly through the upper wire, the center or centers of curvature of the deck being situated on the side of the lower wire loop, (c) a second forming roll situated closely after the forming shoe in the direction of web travel within the loop of the lower wire and guiding the joint run of the two-wire dewatering zone, the run of the two-wire zone being curved downwardly over a sector of the forming roll wherein the web is further dewatered in the upward direction, and (d) wherein the upper and lower wires have a joint run over the range of the first and second forming rolls and the forming shoe situated between them, which joint run is arranged such that after an initial downward dewateringhas taken place to an appropriate extent through the lower wire within the initial single-wire dewatering zone, dewatering takes place within the two-wire dewatering zone asymmetrically substantially upwardly through the upper wire, first within the sector of the first open forming roll in two directions through both of the upper and lower wires, whereupon within the range of the following forming shoe, dewatering takes place mainly upwardly through the upper wire, and whereupon the dewatering pressure is further increased within the range of the second forming roll with the dewatering continuing mainly through the upper wire for substantially completing the asymmetric dewatering of the web in the two-wire dewatering zone.

In the present application, it will be understood that reference to the wires and the web being curved "upwardly" and "downwardly" means a change in their running direction upwardly or downwardly, respectively.

With respect to the theory of draining through a two-wire curved forming zone, reference is made to the following publications: Paper och Tra 1972, No. 4, pp. 137 to 146, Jouni Koskimies, Jorma Perkinen, Heikki Puolakka Eero Schultz, Bjorn Wahlstrom: "A Drainage Model for the Forming Zone of a Two-Wire Former" and Pulp and Paper Magazine of Canada, vol. 74, No. 2/February 1973, pp. 72 to 77, E. G. Hauptmann and J. Mardon: "The Hydrodynamics of Curved Wire Formers".

In accordance with the invention, the sequence of rotary is arranged to adjust stationary draining elements and the ratios of draining proportions occurring therein so that an optimum compromise is achieved with respect to the formation, retention and power consumption of the forming section as well as with respect to wire wear. Moreover, the present invention makes it possible to achieve a selective adjustment of the draining or dewatering capacity as well as a selective adjustment of the quantities and ratios of dewatering through the upper and lower wires to thereby achieve the objects of the invention as set forth above.

Many important advantages are provided by the present invention with respect to prior art two-wire forming methods in which only rotary draining elements are used, such prior art formers constituting the starting point of the invention.

One very important advantage is that an improved formation is obtained through the use of the curved forming shoe as described in greater detail below.

By appropriately selecting the radius of curvature of the shoe and/or through a continuous or stepwise variation in the radius of curvature and/or by adjusting the position of the shoe, it is possible to control the dewatering capacity and even the direction of dewatering provided by the shoe. In this manner, it is possible to adjust the dewatered volume during the single-wire initial dewatering phase of the forming process within wider limits than has been possible with prior art methods so that the dewatering which occurs in the initial single-wire dewatering zone is such that an appropriate amount of water will remain within the web to be dewatered in accordance with the invention subsequently through the upper wire in the two-wire dewatering zone by the roll-shoe combination.

The use of the curved forming shoe following the first dewatering forming roll advantageously prevents the formation of transverse wrinkles in the web by providing an appropriate tension in the joint two-wire run while reducing the length of the free two-wire run between the first forming roll and the forming shoe. The use of the curved shoe enables the covering angle to be reduced thereby allowing the web forming section to have a compact construction. Since the forming shoe is a stationary element, its shape can be chosen with a greater degree of flexibility than in the case of dynamic elements, such as rolls, thereby enabling an optimization with respect to web formation, dewatering, and mechanical effects, such as the lateral stretching of the wires.

The curved cover structure or deck of the shoe may define an open surface constituted by a plurality of parallel, mutually spaced transversely extending lists. By this construction, pulsations in the dewatering pressure are produced as the two-wire run with the web sandwiched therebetween is guided over the forming shoe. Such pressure pulsations improve web formation and enable dewatering through the lower wire in addition to the upward dewatering of the web. Thus, if desired, dewatering of the web can be adjusted both with respect to the quantity as well as with respect to the ratio of drainage through the top and bottom wires by providing suction arrangements with the curved drainage shoe.

Another important advantage provided by the present invention is that a more efficient drainage is obtained due to the longer active dewatering zone. Other advantages are improved retention and a more uniform distribution of filler agents and fines, i.e., an improved structural symmetry of the web. Still another advantage of the forming method according to the present invention is reduced dusting of the faces of the web during printing compared to webs manufactured by conventional fourdrinier wire sections. Still other advantages in using the forming method according to this invention include a reduction in wire marking in the paper produced and considerably lower porosity relative to the paper produced with a usual forming method on a fourdrinier wire section. The surface and strength properties of the paper are improved and important economies in manufacture are achieved.

A forming method in accordance with the present invention is particularly well suitable for the modernization of existing fourdrinier wire sections as well as for new machines.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 3 is a schematic detail view on an enlarged scale illustrating a forming shoe comprising a component of the web-forming section constructed of a plurality of parallel, mutually spaced transversely extending lists or foils;

FIG. 4 is a schematic side elevation view of the two-wire dewatering zone of the web-forming section shown in FIG. 1, designating its various dimensional parameters;

FIGS. 6*a* and 6*b* are schematic side elevation views of pilot web-forming sections used in experimental trials for testing web formation, while applying the method in accordance with the invention.

DESCRIPTION OF THE PREFERRED EMBODIMENTS

Figure 1:
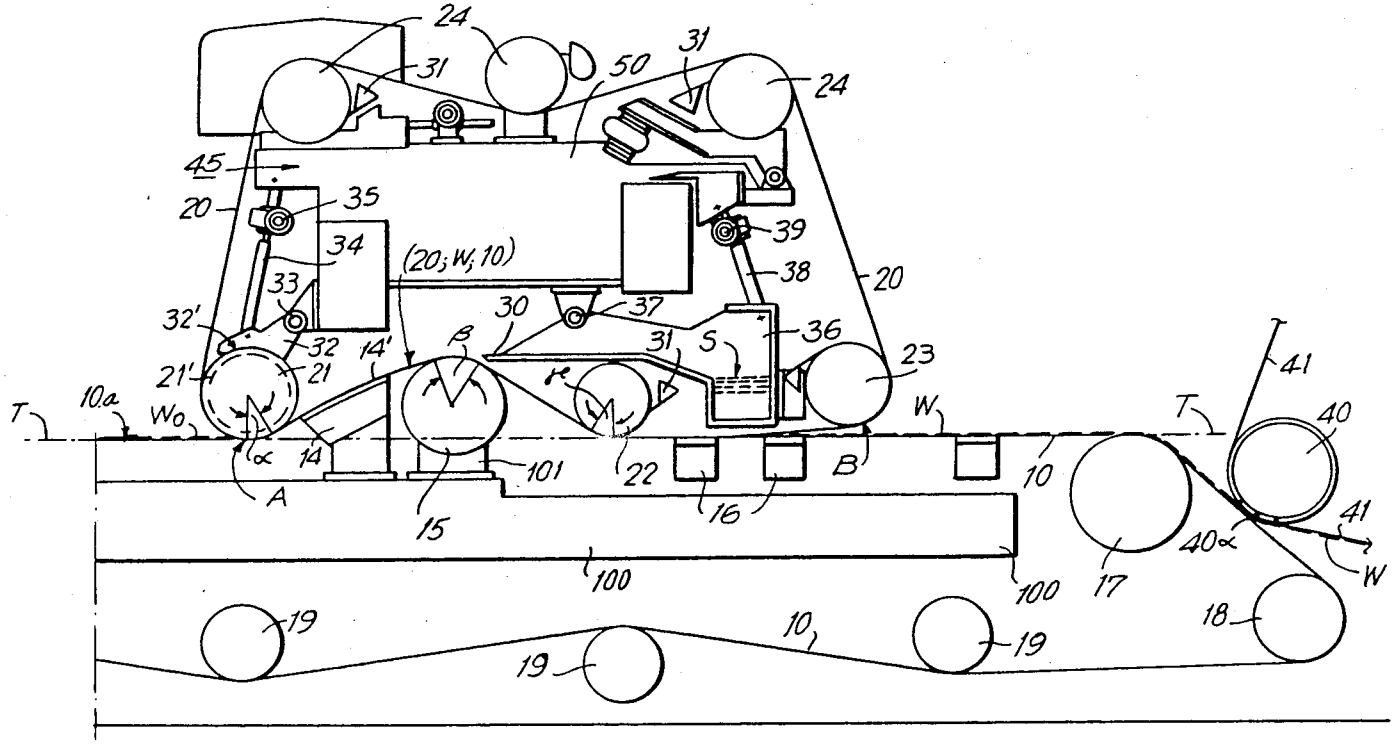
FIG. 1 is a schematic side elevation view of a web-forming section in which the method of the present invention is applied after rebuilding of a conventional fourdrinier wire section.

In accordance with the embodiment illustrated in FIG. 1, for applying the invention a fourdrinier forming section of a paper machine comprising a conventional wire loop 10 has been rebuilt in accordance with the principles of the invention to convert it to a hybrid web-forming section. The plane of the substantially horizontal top wire run of the original fourdrinier forming section is designated T—T. The forming section comprises a frame 100 of the existing or original wire part, dry suction boxes 16, a wire drive roll 17, a wire reversing roll 18, and guide rolls 19 which guide the lower run of the wire 10. All of these elements constitute components of the original wire part.

In the modernization or rebuilding of the fourdrinier wire section, a forming shoe 14 having a curved deck 14' is mounted on the existing frame 100. Thereafter in the direction of run of the machine, a smooth-faced, solid-mantle forming roll 15 is mounted on the frame 100 by means of bearing supports 101.

An upper wire unit 45 comprises a frame portion 50 on which various components are mounted. The wire loop of an upper wire unit 20 is guided from an initial region A of a two-wire dewatering zone by an open forming roll 21 having a hollow face 21' followed by the forming shoe 14, then by the second solid-mantle forming roll 15, and then by a first reversing roll 22 situated within the upper wire loop 20. The run of the two-wire dewatering zone returns to the level of the original plane T—T of the lower wire 10 in the region of the first reversing roll 22. The two-wire dewatering zone ends at a second reversing roll 23 of the upper wire 20. The upper guide rolls of the upper wire 20 are denoted by reference 24. The rolls 22, 23 and 24 are provided with doctor blades 31.

Prior to the two-wire dewatering zone, which begins at the initial region A and ends at a point before the region designated B, there is an initial single-wire dewatering zone. This zone is constituted by an initial run 10*a* of the wire 10 running in the plane T—T. Dewatering of the web-forming stock takes place in the initial single-wire dewatering zone, also designated 10*a*, by means of dewatering or drainage means situated below the wire between the slice of the headbox and the region (not shown), A which means not necessarily be replaced for the retrofit. Within the initial single-wire dewatering zone, dewatering of the web takes place in a downward direction through the wire run 10*a*. Such dewatering is preferably carried out relatively gently so that the possibilities for good formation and retention are maintained so that a sufficient amount of water will remain in the web for subsequent dewatering or drainage in an upward direction.

As described above, the loop of the upper wire 20 forms a joint run with a part of the loop of the wire 10 subsequent to run 10*a* to form the two-wire dewatering zone within which the web, initially formed on the single wire zone through a downward dewatering, is dewatered substantially upwardly. The two-wire dewatering zone begins at a region designated A wherein the lower and upper wire loops 10 and 20 converge at the first dewatering forming roll 21.

Immediately after the initial region A, the joint run of the wires 10 and 20 and the web sandwiched therebetween is curved upwardly over the sector $\alpha$ of the open forming roll 21. As discussed below, the magnitude of the sector $\alpha$ is generally in the range of about 2° to 60°. Within the sector $\alpha$, the dewatering pressure is produced mainly by the effect of the tensioning between the wires 10 and 20 while the centrifugal force promotes dewatering. The web sandwiched between lower and upper wires 10 and 20 is dewatered bidirectionally on the sector $\alpha$ of forming roll 21, however, as discussed below, predominantly upwardly through upper wire 20.

After the sector $\alpha$, there is a short joint straight, free run of the wires 10 and 20 whereupon the run of the wires 10 and 20 is curved downwardly over the surface 14' of the shoe 14. Within the area of the shoe 14, dewatering of the web takes place under the effect of the compression between the wires 10 and 20 and by the effect of centrifugal forces acting upwardly through the upper wire 20. The web is dewatered predominantly, if not entirely, upwardly through wire 20 as it passes over shoe 14.

After the trailing edge of the shoe 14, there is another short straight, free joint run of wires 10 and 20 whereupon the joint run of wires 10 and 20 is curved downwardly over the sector $\beta$ of the forming roll 15, which preferably comprises a solid roll. The web is again dewatered upwardly through wire 20 as it passes over the sector $\beta$ of solid forming roll 15.

The joint run of the wires 10 and 20 is then curved upwardly over the sector $\gamma$ of the reversing roll 22 until it joins and becomes resituated in the original plane T—T of the lower wire 10. The twin-wire section terminates at the point prior to or at the region designated B.

The web W is carried further on the lower wire 10 and is detached therefrom on a downwardly slanting run between the rolls 17 and 18 by the effect of a suction zone 40$\alpha$ of a pick-up roll 40 whereby the web is transferred onto a pick-up fabric 41 which moves the web further into the press section (not shown).

Figure 5A:
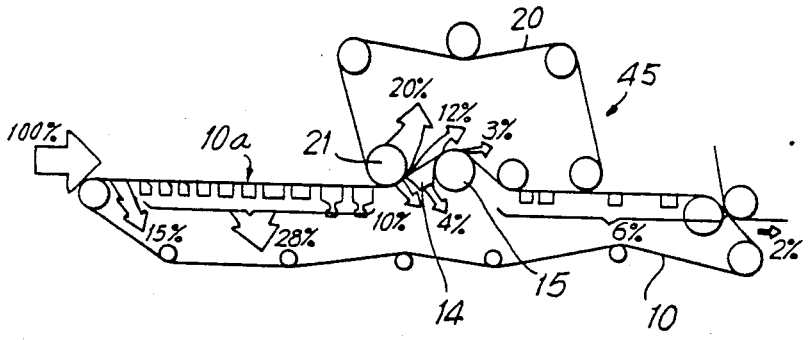
FIGS. 5*a* and 5*b* are schematic side elevation views of the web forming sections shown in FIGS. 1 and 2 respectively and illustrating typical web dewatering percentages which occur at the various dewatering zones and components thereof.

The dewatering process of the web which is carried out in the forming section illustrated in FIG. 1 which comprises a modernized or rebuilt fourdrinier wire section will now be described in greater detail with reference to FIGS. 1 and 5*a*. The forming section illustrated in FIGS. 1 and 5*a* comprises a top or upper wire unit 45 placed on a conventional fourdrinier wire section in the manner described above. The length of the single-wire predewatering zone 10*a* before the two-wire dewatering zone is chosen in relation to the paper grade and speed range of the machine. Some drainage elements have been removed from the existing fourdrinier table and replaced by the forming shoe 14 and the solid roll 15. The web forming is started on the original fourdrinier section, usually using the existing dewatering element used prior to the rebuild. The optimum location of the new top wire unit 45 has been predicted by experience and by pilot machine trial runs. The stock W undergoes a gentle downward dewatering on the initial single-wire dewatering zone through the wire run 10*a*. Referring to FIG. 5*a*, one example of typical advantageous dewatering percentages and directions at the various points of the web-forming section are illustrated, the indicated percentages being of the total dewatering which occurs in the forming section. It is understood that the indicated percentages are illustrative only and that the dewatering quantities may vary from those shown in FIG. 5*a* by an amount of about plus or minus 10 to 25%. Thus, a total of about 43% of the total dewatering occurs in the single-wire predewatering zone 10*a*, about 15% occurring at the forming board immediately after the headbox while the remaining 28% occurs over the substantial length of the initial single-wire dewatering zone. By the time that the web reaches the end of the predewatering zone 10*a*, the gentle downward dewatering has occurred to an extent sufficient that the web has obtained a suitable degree of felting, i.e., a degree of felting such that the fibres are unable in subsequent dewatering stages to move substantially with respect to each other.

After the predewatering zone 10*a*, the web, designated $W_0$, enters the two-wire section at its initial region A. The joint run of the wires 10 and 20 and the web sandwiched therebetween is caused to curve upwardly over the sector $\alpha$ of the open forming roll 21. The forming roll 21 is preferably a drilled roll whose surface is countersunk to provide a reception volume for water drained from the web.

When the forming fabrics or wires with the web sandwiched therebetween travel over the sector $\alpha$ of the face 21' of the open roll 21, a dewatering pressure is developed in the web. The pressure is proportional to the tension in the lower wire 10 and inversely proportional to the radius of roll 21. A deceleration takes place in the web at a rate which corresponds to the pressure. This causes a redistribution of the fines and fibres within the web and is beneficial with respect to web formation.

Although the dewatering pressure which acts in a direction towards the roll 21, is somewhat smaller than that acting outwardly due to centrifugal force, the upward dewatering, i.e., dewatering into the roll 21 through the upper wire 20 is greater than the downward dewatering because of the fact that the partially formed web coming from the single-wire dewatering zone causes a high resistance against downward dewatering. Thus, although the web is dewatered through both wires 10 and 20 as it travels over the sector $\alpha$ of roll 21, the dewatering which takes place through the upper wire 20 is usually about 2 to 4 times the dewatering through the lower wire 10. This drainage distribution is due to the fact that in the single-wire initial dewatering zone 10*a* a layer of fiber material is created which impedes the passage of water in the downward direction. Indeed, under certain circumstances, substantially no dewatering may take place through the lower wire 10 within the sector $\alpha$ of the roll 21. On the other hand, on some occasions it may be proper to use a suction zone within the sector $\alpha$ of the roll 21 which makes it possible to closely control the dewatering and the ratios of dewatering at various points in the web forming section.

Referring to FIG. 5*a*, it is seen that substantial dewatering occurs over the sector α of forming roll 21. As indicated, 20% of the total dewatering occurs there upwardly through top wire 20 with 10% of the total dewatering occurring downwardly through the lower wire 10.

The joint run of wires 10, 20 with the web sandwiched therebetween then passes over a short straight free run onto the curved cover structure 14' of the forming shoe 14. As discussed below, the cover structure 14' of the forming shoe 14 may comprise a multifoil construction. The dewatering of the web continues mainly upwardly on the surface 14' of forming shoe 14. At this stage, the web has been dewatered to a large extent prior to reaching the forming shoe 14. Both sides of the web have been formed during the dewatering process either on the single-wire dewatering zone or on the forming roll 21 and they function as filtering layers for further dewatering which is still to take place. The radius of curvature of the curved cover 14' of the forming shoe 14 is relatively large which results in a relatively low dewatering pressure acting on the web. These two facts together ensure a relatively gentle dewatering as the web passes over the curved cover structure 14' of the forming shoe 14. The web is dewatered rather gently as an upward drainage through the top wire 20 mainly and by the effect of the tension between the wires 10 and 20 under the effect of centrifugal force caused by the curvature of the shoe 14. As seen in FIG. 5*a*, a typical situation is that of the total dewatering 16% occurs as the web passes over the curved forming shoe 14, 12% occurs upwardly through the top wire 20 and 4% takes place through the lower wire 10.

The final dewatering which takes place in the two-wire dewatering zone occurs as the web passes over the sector β of the solid, smooth-faced forming roll 15. The pressure causing upward dewatering over the sector β of the forming shoe 14 is substantially increased by selecting the radius of the roll 15 so as to be substantially smaller than the radius of curvature R of the curved forming shoe 14. As seen in FIG. 5*a*, typically about 3% of the total dewatering occurs through the upper wire 20 at the forming roll 15.

Dewatering of the web taking place in the wire section is completed with conventional flat suction boxes and a couch roll after the two-wire dewatering zone. Because of the high dry matter content of the web attained after the two-wire dewatering zone, the number of flat suction boxes required is in a web forming section in accordance with the present invention, lower than in a conventional fourdrinier section and they can be used with lower vacuums. This contributes to longer wire life and savings in drive and vacuum power. The upper wire unit 45 requires only a drive power sufficient to overcome any friction from the bearings and doctor devices.

The amount of upward dewatering which occurs in the two-wire dewatering zone depends to a great extent on the dry matter content of the web as it enters the two-wire dewatering zone. For example, with a web, having a relatively high water content up to 45% of the total headbox flow can be drained upwardly through the top wire 20. In normal operation conditions the range of about 30% to 35% of the total dewatering would be in the upward direction. In the illustrative example of FIG. 5*a*, 35% of the total dewatering occurs through the top wire 20 in the two-wire dewatering zone.

The following features of the embodiment of FIG. 1 should also be noted with reference to the method of the invention. The upper wire unit 45 is preferably designed such that it can be shifted away from its illustrated position as an integral entity such, for example, as for maintenance. When the invention is applied in the modernization of a conventional fourdrinier wire part of a paper machine as shown in FIG. 1, no essential changes need be made to the frame 100 since the forming shoe 14 and the roll 15 can be mounted in a simple and easy manner on the existing frame 100. The upper wire unit 45 comprises a frame 50 to which, for example, supporting means 32 for the first forming roll 21 are mounted, the supporting means 32 being connected to the frame 50 by means of horizontal articulated shafts 33. The open roll 21 is pressed against the lower wire 10 by means of rods 34 which can be shifted by means of worm gears 35. Water collecting means 32' are provided in association with the supporting means 32 by means of which the water escaping from the web W into the open face 21' of the roll 21 is collected. Moreover, in connection with the roll 21, cleaning means (not shown), known per se, such as water jet devices, are provided.

Water collecting means are provided after the forming roll 15 within the upper wire loop 20 mounted on the frame 50 by which water drained from the web within the area of the forming shoe 14 and the second forming roll 15 through the upper wire can be collected. In the illustrated embodiment, the water collecting means comprise a water collecting trough 36 the front edge 30 of the bottom of which is located within the region of a horizontal plane tangent to the uppermost region of the roll 15. The water collecting trough 36 is suspended by means of articulated shaft 37 mounted on the frame 50. The trough 36 is arranged so as to be pivotable around the articulated shafts 37 by means of rods 38 which are operated by a worm gear 39. By means of rods 38 and gear 39, it is possible to adjust the position of the front edge 30 of the trough bottom at an appropriate position with a view toward collecting water drained from the web. The trough 36 includes appropriate devices and channels by which the water is removed through the side of the paper machine. The water level in the trough 36 is designated by reference S.

Figure 2:
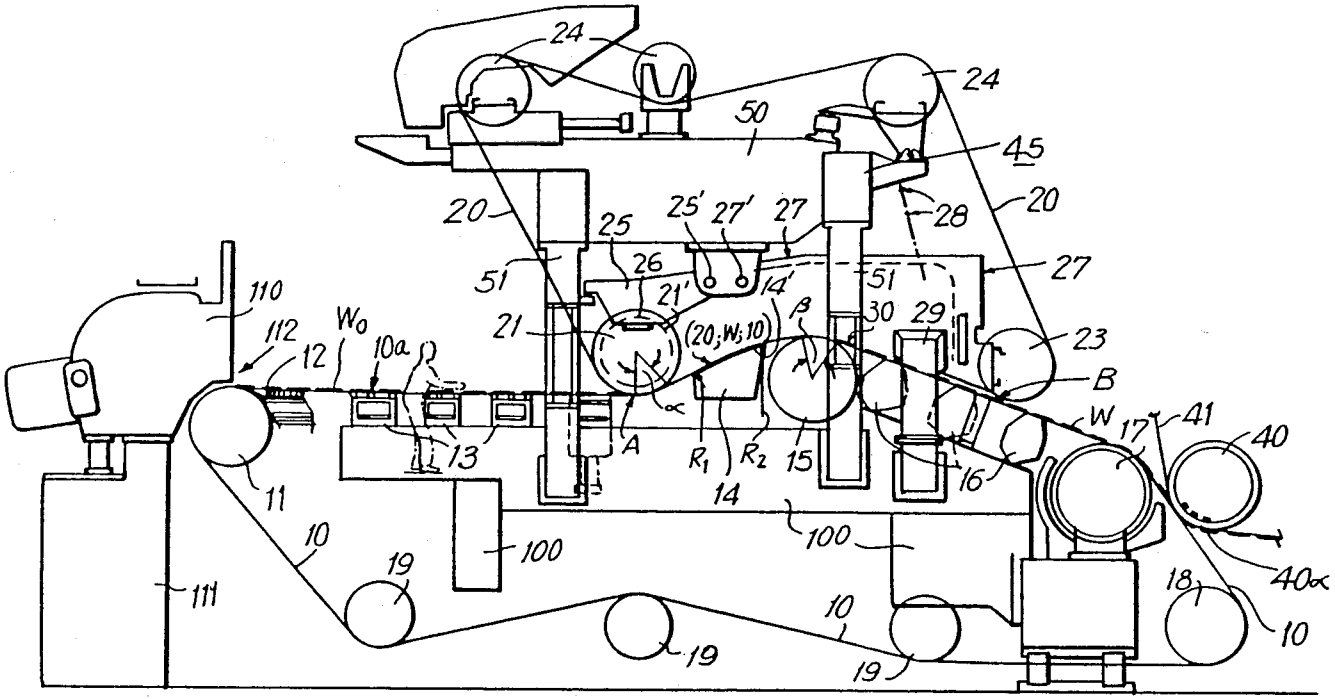
FIG. 2 is a schematic side elevation view of a web-forming section in a new paper machine having the necessary apparatus, for performing a method in accordance with the present invention.

Referring now to FIG. 2, a preferred embodiment for applying the present invention in a new paper machine will now be described. The forming section illustrated in FIG. 2 comprises a headbox 110 mounted on a base or footing 111, the web-forming stock in the form of a dilute fiber suspension being supplied through the slice 112 of the box onto the substantially horizontal initial dewatering zone 10*a* of the lower wire 10 of the forming section constituted. Within the initial single-wire dewatering zone 10 a forming board 12 and foil lists 13 are provided. The lower run of the lower wire 19 is guided by guide rolls 10. The forming section further comprises an upper wire unit 45 having a frame 50 to which rolls 21, 23 and 24 are mounted which guide the run of the upper wire loop 20. The two-wire draining or dewatering zone begins at the region designated A, i.e., from the beginning of the sector α of the open roll 21 which is provided with a hollow face 21'. The sector α of the roll 21, over which the run of the wires 10 and 20 is curved upwardly, is followed by a forming shoe 14 after a short straight joint run thereof. After the shoe 14, the joint run of the wires 10 and 20 follow a short straight run whereupon the joint run of wires 10 and 20 are turned downwardly over a sector $\beta$ of the second forming rolls 15 having a solid or plain surface. Following the sector $\beta$, the joint run of wires 10 and 20 is directed downwardly as a straight run over the range of which dry suction boxes 16 are provided within the loop of the lower wire 10. In this manner it is substantially assured that the web W will follow the lower wire 10. The web W is detached in a manner known per se within the run of wire 10 between the rolls 17 and 18 by means of a suction sector 40$\alpha$ of a pick-up roll 40 whereupon the web is transferred onto the pick-up fabric 41 to be carried into the press section of the paper machine.

The dewatering of the web within the single-wire initial dewatering (predewatering) zone 10*a* and within the subsequent two-wire dewatering zone between the regions A and B is substantially similar to that described above in connection with the embodiment of FIG. 1.

Figure 5B:
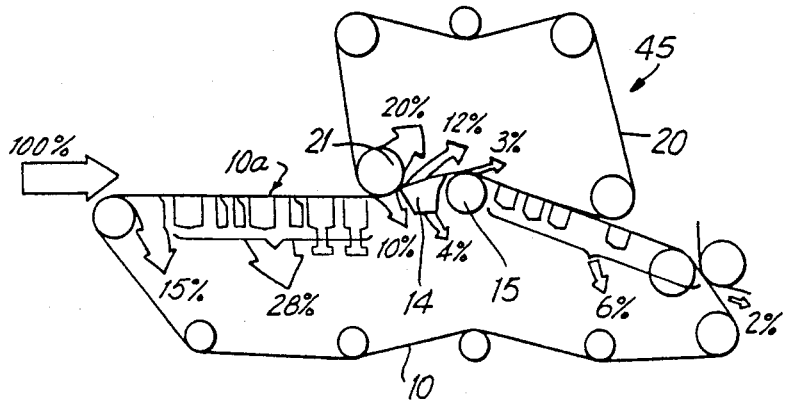

In this connection reference is made to FIG. 5*b* wherein typical dewatering percentages and directions for the embodiment of FIG. 2 are illustrated. It is again emphasized that these values are illustrative only and the actual dewatering percentages can vary by as much as 10 to 25% from those shown. In any event, a substantial upward dewatering of the web takes place in the two-wire dewatering zone.

An important difference between the rebuilt fourdrinier machine embodiment of FIG. 1 and the new machine embodiment of FIG. 2 is that after the smooth-face forming roll 15 in the embodiment of FIG. 2, there is no roll which corresponds to the roll 22 which is located within the loop of the upper wire 20 in the case of the FIG. 1 embodiment. Rather, a reversing roll 23 for the upper wire 20 is provided. Another difference between the embodiments of FIGS. 1 and 2 is that between the roll 15 and the drive roll 17 in the embodiment of FIG. 2, there is a straight downwardly slanted joint run of wires 10 and 20 over which run dry suction boxes 16 are located. In the case of either embodiment, the use of dry suction boxes 16 is not essential.

Water collecting means 25, 27 are provided within the upper wire loop 20 in association with the frame 50 of the upper wire unit 45 by which means the water is collected which is drained from the web W upwardly through the upper wire 20 is collected. More particularly, a water collecting trough 25 is located above the open roll 21 having the hollow face 21' which has a portion 26 which opens towards the open face 21' of roll 21, the water expelled through the cavities of the face of the roll 21 being collected thereby within the trough 25. The trough 25 is attached to the frame 50 by means of articulated shaft 25'. If necessary, the trough 25 is arranged so as to be pivotable around an articulated shaft 25' to adjust its position. The water collecting means includes a second draining trough 27 mounted on the frame 50 by means of conventional power devices, designated 28. The trough 27 is constituted by an upper wall and a lower wall the front edge 30 of the latter being situated above the joint run of the wires 10 and 20 after the roll 15. The draining trough 27 includes channels 29 through which the water collected is removed at the side of the paper machine.

It is a characteristic feature of the embodiment of the forming section illustrated in FIG. 2, as well as the FIG. 1 embodiment thereof, that the upward dewatering through the upper wire 20 begins within the area of the open-faced forming roll 21, albeit extremely gently at the beginning thereof, and that this dewatering continues within the area of the shoe 14, preferably with the draining pressure increasing in a stepwise or continuous manner over the range of the shoe 14. Such stepwise or continuous increase in the drainage pressure can be achieved, for example, by providing that the radius of curvature of the shoe 14 becomes smaller in a stepwise or continuous manner from the front or leading edge of the shoe towards its rear or trailing edge. Thus, referring to FIG. 2, the radius of curvature $R_1$ of the leading edge of shoe 14 is significantly larger than the radius of curvature $R_2$ of the trailing edge. The draining pressure is even further increased within the sector $\beta$ of the smooth-faced roll 15. Moreover, since there is a straight joint run of the wire 10 and 20 between the sector $\alpha$ of roll 21 and the forming shoe 14 as well as between the forming shoe and the sector $\beta$ of the roll 15, over which straight runs the dewatering or draining pressure is immediately reduced to a substantially zero value, a varying pulsation of the draining pressure is thereby obtained which has been found to have a favorable effect on the formation of the web W. It is also noted that in the embodiment of FIG. 2, after the sector $\beta$ of roll 15 there is no sector which corresponds to the sector $\gamma$ of the FIG. 1 embodiment. However, drainage through the lower wire 10 is provided in this region by means of dry suction boxes 16 if such drainage is found on the whole to be necessary at this stage of web formation.

It will also be recognized and is of essential importance that the drainage taking place in the upward direction be sufficient in the particular application and, if necessary, adjustable.

According to the invention, a sequence of draining steps is provided wherein the relative dewatering pressures and amounts, and their directions can be varied in a favorable manner with a view towards optimizing retention, formation and drainage capacity. Moreover, these objects are accomplished by relatively simple structures whose construction and operation have separately been established and tested in the past.

Referring to FIG. 4, various operational dimensions of the two-wire dewatering zone for applying the method in a web forming section shown in FIG. 1 are illustrated. Various components of the two-wire zone can be positionally adjusted to vary the respective dimensions in accordance with the particular application as determined by the consistency of the web forming stock, the dewatering percentages desired, the paper grade and the like.

The angle $\alpha$ of the sector of the open forming roll 21 over which the joint run of the lower and upper wires 10, 20 and web W situated therebetween can be within the range of about 2° to 60° and most advantageously within the range of about 5° to 40°. A typical advantageous value of the angle $\alpha$ is in the range of between about 20° to 40°.

The angle $\Delta$ of the curved deck 14' of the forming shoe 14 can be within the range of between about 5° to 35° and most advantageously within the range of about 10° to 25°. A typical advantageous value of the angle $\Delta$ is about 20°.

The angle $\beta$ of the sector of the smooth-faced forming roll 15 over which the joint run of wires 10, 20 and the web W situated therebetween pass can be within the range of about 20° to 70° and most advantageously within the range of about 30° to 60°. A typical advantageous value of the angle $\beta$ is in the range of between about 25° to 50°.

The joint free run A between the forming roll 21 and the forming shoe 14 can be within the range of about 100 to 500 mm and most advantageously within the range of between about 200 to 300 mm. A typical advantageous value of the free run A is in the range of between about 200 to 400 mm.

The length B of the free joint run between the forming shoe 14 and the smooth-faced forming roll 15 can be within the range of about 100 to 500 mm and most advantageously within the range of about 200 to 300 mm. Typically used advantageous values of the length B is between about 300 to 400 mm.

Advantageous constructional embodiments of the various drainage or dewatering elements of a web-forming section for applying the method of the invention will now be described. As mentioned above, the first forming roll 21 must have a relatively open face so that dewatering can take place upwardly through the upper wire 20. The roll 21 may be either a vented roll, a blind-drilled roll or a through-drilled roll. Preferably, the roll 21 is a grooved roll covered with a wound profile band in which the open proportion of the face, i.e., the percentage of the face occupied by grooves or holes over the entire mantle area, is preferably at least about 50%. The open hollow-face roll 21 is preferably covered by a wire sock. In some special applications, the roll 21 may constitute a suction roll.

With respect to the construction of the forming shoe 14, the dewatering pressure P acting on a web as a joint wire run with the web sandwiched therebetween passes over a curved guiding member is known to be equal to T/R, where T is the tension of the covering wire and R is the radius of curvature of the curved guiding member. The dewatering of the web as it passes over the curved deck 14' of the shoe 14 is thus influenced by the dewatering pressure, the latter being determined by the tension of the wire 20 which is typically in the range of between about 3 to 8 kilonewtons per meter. The radius of curvature R of the deck 14' of the shoe 14 may be constant or, alternatively, the radius of curvature R may become smaller in the running direction of the web W. The radius of curvature of the deck 14' is advantageously chosen to be in the range of between about 0.4 to 6 meters and preferably within the range of between about 2 to 5 meters. In a preferred embodiment, the shoe 14 has a deck 14' having a radius of curvature R of about 3 m. In a second preferred embodiment, the deck 14' of shoe 14 has a plurality of radii of curvature R which diminish in the running direction of the web, the radius of curvature being about 6 meters at the leading edge and about 0.3 meters at the trailing edge. It is seen that in the case where the deck 14' has diminishing radii of curvature, the dewatering pressure acting on the web increases as it passes over the curved deck.

The deck 14' of shoe 14 which guides the wire 10 may be solid or provided with ribs and an at least partly open hollow-faced deck 14' is preferable, e.g., one that is provided with grooves which extend transversely with respect to the direction of running of the web W. When an open deck 14' of shoe 14 is utilized such as shown in FIG. 3, the grooves or holes formed therein may be connected to a vacuum system and by means of appropriately adjusting the subatmospheric pressure within the deck 14' of the shoe it is possible to affect the ratio of quantities of water drained upwardly and downwardly, respectively, at least to some extent. The length of the shoe 14 is preferably such that the contact angle of the lower wire 10 with the deck 14' is about 5° to 45° depending upon the radius of curvature R of the deck. The run of the two-wire section 10, 12 changes its direction downwardly at a corresponding angle of about 5° to 45° within the region of the shoe 14.

The main function of the second solid or smooth-surfaced forming roll 15 is to guide the wires 10 and 11 as well as the web W located between them downwardly and to induce some dewatering through the upper wire 20. Although it is possible to use as the roll 15 either a smooth-faced mantle solid roll or an open-faced roll, a smooth roll 15 is considered preferable. When an open roll is used, it is advantageous to use a grooved roll without a wire covering. The diameter of the roll 15 is most preferably within the range of about 600 to 1500 mm. The roll 21 preferably has a diameter within the same range.

When applying the method in rebuilding an existing wire section shown in FIG. 1, the lower faces of the rolls 21, 15 and 22 are kept preferably at substantially the same level, i.e., at the level T—T of the original fourdrinier wire 10. The rolls 21, 15, 22 and 23 are arranged so that the free spaces defined between them are as small as possible it being understood, however, that a sufficiently long forming shoe 14 having an appropriate radius of curvature R can be placed between the rolls 21 and 15 and that a water collecting trough 36 can be placed between the rolls 22 and 23. Moreover, the distance between the rolls 22 and 23 is preferably sufficiently long so as to accommodate one or two dry suction boxes 16.

In the embodiment of FIG. 2, the rolls 21, 15 and 23 are arranged at substantially the same level and such that the free spaces defined between them are as small as possible keeping in mind that sufficient space is provided between the rolls 15 and 23 for a water collecting trough 27 and for one to three suction boxes.

In the embodiment of FIG. 1, preferably one to three dry suction boxes 16 are used while in the embodiment of FIG. 2, two to five dry suction boxes are appropriate.

It should be again emphasized that the dewatering which occurs in the single-wire initial dewatering zone **10*a* constitutes a gentle downward dewatering so as to obtain a good retention of fillers and/or fines. Moreover, the amount of dewatering which takes place over the single-wire zone 10*a* must not be excessive so that a sufficiently larger amount of water remains for upward dewatering through the upper wire 20. An adjustment of the quantities and proportions of dewatering taking place in both directions can be accomplished by appropriate selection of the radii and design of the faces of the rolls 21 and 15, by appropriately selecting the curvature and openness of the deck 14' of the shoe 14, and through the adjustment of the positions and relative locations of the components 21, 14 and 15. If necessary, a fine adjustment of the final dewatering and of the distribution of fines in the web can be accomplished by means of the dry suction boxes 16**.

A web forming method in accordance with the present invention provides the significant advantage of improved web formation and improved retention of fillers and fines in the web. In this connection, experimental trial runs were conducted by the pilot paper machine at the Rautpohja Works of Valmet Oy in Finland. In particular, the web formation obtained by prior art web forming methods incorporating a two-wire dewatering zone without a forming shoe, as illustrated in FIG. 6*b*, was compared with the web formation obtained in a forming section as shown in FIG. 6*a* incorporating a two-wire dewatering zone and by using a method in accordance with the present invention. A "Valmet Formation Tester" was used to compare the web formation obtained in the trial runs. Such a Formation Tester optically measures the web formation, i.e., a small measuring head having a diameter of about 0.2 mm measures the variation of light transmitted through the paper sample produced, the sample being passed evenly over the measuring head. A light source is situated behind the paper, i.e., on the opposite side of the paper from the measuring head. The variation in light transmitted through the paper is converted electrically to a relative reading which corresponds in percentage to the variation or unevenness of formation. The smaller the reading, the more even is the paper formation.

The tests were conducted for three basis weight classes of woodfree fine paper with the following results.

For a basis weight class of 100 g/m$^2$, the best reading obtained by the web forming section in accordance with the present invention (FIG. 6*a*) was 5.8% with 98 g/m$^2$ paper. In the case of the web forming section in FIG. 6*b*, the best values obtained were 6.7% with 91 g/m$^2$ paper and 6.8% with 100.5 g/m$^2$.

For paper in a basis weight class of 70 g/m$^2$, the best reading for the web forming section in accordance with the present invention (FIG. 6*a*) was 6.3% with 72 g/m$^2$ paper while the best reading for the web forming section without a forming shoe (FIG. 6*b*) was 6.7% with 72 g/m$^2$ paper.

For paper in a basis weight class below 50 g/m$^2$, the best reading obtained for the web forming section in accordance with the invention (FIG. 6*a*) was 8.5% for 49.5 g/m$^2$ paper while the best reading for the web forming section which did not include a forming shoe (FIG. 6*b*) was 9.1% for 47 g/m$^2$ paper.

Accordingly, it has been demonstrated that with woodfree fine papers which have high formation requirements, the web manufactured by a method according to the present invention shows from 0.5 to 1.0 percentage units better formation than a web manufactured by a method without a forming shoe such as shown in FIG. 6*b*. This is considered to conclusively establish that the web forming method in accordance with the present invention is advantageous with respect to web formation.

Moreover, formation measured by the Valmet Formation Tester for standard newsprint manufactured in a machine utilizing the web forming method in accordance with the present invention has ranged from 9.2% to 10%. Newsprint manufactured by a conventional fourdrinier web-forming method using the same furnish had values of about 12%.

Furthermore, the web forming method in accordance with the invention improves retention of fillers and fines within the web. The improved retention and formation are especially striking when it is considered that the drainage capacity provided by a web forming section in which the method in accordance with the invention is utilized is increased by as much as 35% compared with dewatering in a conventional fourdrinier forming section.

Referring to FIG. 3, the curved deck 14' of the forming shoe 14 can advantageously be constructed by a plurality of transversely extending lists or foils providing an open surface for the forming shoe. This construction is advantageous in it causes pulsations in the dewatering pressure on the web as the joint wire run passes over the curved deck defined by the series of transversely extending foils. The pulsating dewatering pressure improves web formation.

Moreover, after the web has been dewatered by the elements preceding the forming shoe, there are some fine fibers in the center of the web which have certain freedom so as to be redistributed by the pressure pulses generated by the foils or lists of the forming shoe as shown in FIG. 3. As noted above, both sides of the web have been formed first on the single-wire dewatering zone and subsequently on the forming roll 21. These formed web sides function as filtering layers for any dewatering which still remains to take place. As noted above, the relatively large radius of the forming shoe results in a low dewatering pressure. These two facts together insure a gentle dewatering of the web as it passes over the curved forming shoe in spite of the pressure pulsations caused by the foils of the forming shoe. The discontinuous drainage on the forming shoe thus further facilitates the improved formation of the web.

Other important advantages are obtained by the web forming method in accordance with the invention.

It has been found that paper produced by a web forming section in accordance with the invention has less wire marking than in paper produced on a conventional fourdriner machine. This is apparently due to the arrangement of the dewatering elements and the relatively small sectors of the forming rolls wrapped by the joint wire run before and after the curved forming shoe. As mentioned above, the double sided dewatering provided by the web forming section of the invention insures extremely good filler and fine distribution. In particular, the fillers and fines will be distributed substantially symmetrically over the thickness of the formed paper which enables either side of the paper to be printed upon.

It has also been found that paper produced by a web forming method in accordance with the invention has a considerably lower porosity than paper produced on a conventional fourdrinier machine. This is a direct result of the improved web formation in the absence of pinholes. Thus, it has been found in trial runs that at constant freeness levels, the porosity of woodfree fine paper having a basis weight of 70 g/m$^2$ produced on a conventional fourdrinier machine is about 750 ml/min. After rebuilding the fourdrinier machine for applying the method in accordance with the present invention as seen in FIG. 1, the porosity of the same paper is reduced to about 475 ml/min.

The surface and strength properties of paper produced by the web forming method of the present invention are also significantly improved. The symmetric structure obtained in the paper ensures good printability on both sides of the paper. Loose particles are washed from the surfaces of the paper eliminating any linting problems. Although the strength of the paper is generally determined by the composition of the furnish, it has been found that the improved formation achieved by the web forming method of the invention contributes to an increase in strength of the paper produced.

The forming method of the invention thus produces paper of improved quality and at the same time allows an increased production rate. This leads to a more economical manufacture of paper. Additionally, economies can be achieved in drive and vacuum power consumption.

In summary, a forming method in accordance with the invention provides an improved web formation combined with increased drainage capacity and retention as well as good filler and fine distribution. The formation of transverse wrinkles in the joint run in the two wire dewatering zone is eliminated and reductions are achieved in wire marking on the paper and in its porosity. Surface and strength characteristics of the paper produced in the forming section are improved and economies are achieved in production and power consumption. The forming shoe when provided with a curved deck formed from a plurality of spaced, transverse lists further improves web formation through the production of pulsations in the dewatering pressure and also enables dewatering of the web through the lower wire. Furthermore, the use of a curved shoe enables the covering angle to be reduced contributing to a compact former and, moreover, since the shoe is a static element, as opposed to rolls, its shape can be relatively freely chosen and optimized with respect to formation, dewatering and such mechanical effects as lateral wire stretching.

Another important feature of the forming method of the invention is that by the time the web reaches the leading edge of the forming shoe, it has already been substantially dewatered both on the single-wire dewatering zone and on the open forming roll 21. Indeed, a substantial upward dewatering of the web occurs at the first forming roll 21, the dewatering through the upper wire most advantageously being about 2 to 4 times the amount of water drained through the lower wire 10.

It should also be noted that the web-forming method of the present invention can also be used when forming multi-layer webs. For example, several web-forming units 45 of the type illustrated in FIG. 1 can be placed above the fourdrinier wire 10, one after the other, and a separate, secondary headbox arranged for each additional upper wire unit 45. For example, a separate secondary headbox can be situated at the upper run of the upper wire 20 to supply a pulp layer onto the main web supplied from the main headbox onto the lower wire 10.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method in a web forming section of a paper machine, the forming section including a lower wire loop having an initial, substantially horizontal lower wire run constituting an initial, substantially horizontal single-wire dewatering zone of the web forming section, and an upper wire loop situated over the lower wire loop having a run which forms a joint run with a run of said lower wire loop subsequent to said initial single-wire dewatering zone, said joint run constituting a two-wire dewatering zone of the web-forming section, the method comprising the steps of:

depositing web-forming stock from a headbox onto the single-wire dewatering zone;

predraining the web-forming stock downwardly through the lower wire as it travels in the single-wire dewatering zone supported on the lower wire, for initially forming a fiber network such that retention of fillers and fines is promoted as the web is subsequently dewatered, whereupon the web is passed into the two-wire dewatering zone wherein it is situated between the lower and upper wires of the joint run thereof;

after the predraining step, initially dewatering the web bidirectionally in the two-wire dewatering zone by guiding the joint wire run and web situated therebetween over a sector of a first dewatering forming roll having an open face situated inside the upper wire loop to curve the joint run of the two-wire dewatering zone upwardly, the bidirectional dewatering being both upwardly through the upper wire and downwardly through the lower wire with the upward dewatering being greater than the downward dewatering wherein the web is substantially dewatered;

after the initial bidirectional dewatering step, passing the joint wire run and web situated therebetween over a short, free unsupported run and then further dewatering the substantially dewatered web at least upwardly through the upper wire by guiding the joint wire run and web situated therebetween over a curved deck of a forming shoe to curve the joint run of the two-wire dewatering zone downwardly;

after the further dewatering step, passing the joint wire run and web situated therebetween over a short free unsupported run and then still further dewatering the web upwardly through the upper wire by guiding the joint wire run and web situated therebetween over a sector of a second forming roll to curve the joint wire run of the two-wire dewatering zone downwardly, wherein dewatering takes place within the two-wire dewatering zone asymmetrically; and situating said run of said upper wire loop forming said joint run entirely in and above a plane of said initial, substantially horizontal and planar lower wire run.

2. The method of claim 1 wherein during said initial bidirectional dewatering step, the initially formed web is dewatered upwardly through the upper wire in the range of between about 15% to 30% of the total dewatering which occurs in the forming section, the web also being dewatered downwardly over the sector of the first dewatering forming roll through the lower wire in the range between about 7% to 12% of the total dewatering which occurs in the forming section.

3. The method of claim 2 wherein during the bidirectional dewatering step, the initially formed web is dewatered upwardly through the upper wire in the range of between about 18% to 22% of the total dewatering which occurs in the forming section and at the same time the initially formed web is dewatered downwardly over the sector of the first dewatering forming roll through the lower wire in the range between about 9% to 11% of the total dewatering which occurs in the forming section.

4. The method of claim 1 wherein during the initial bidirectional dewatering step, the initially formed web is dewatered upwardly through the upper wire in an amount equal to about 20% of the total dewatering which occurs in the forming section and at the same time the initially formed web is dewatered downwardly over the sector of the first dewatering forming roll through the lower wire an amount equal to about 10% of the total dewatering which occurs in the forming section.

5. The method of claim 1 wherein during the initial bidirectional dewatering step, the initially formed web is dewatered upwardly through the upper wire an amount about 2 to 4 times the amount the initially formed web is dewatered downwardly through the lower wire.

6. The method of claim 1 wherein during the further dewatering step on the curved deck of the forming shoe, the web is dewatered upwardly through the upper wire in the range of between about 9% to 15% of the total dewatering which occurs in the forming section.

7. The method of claim 6 wherein during the further dewatering step, the web is also dewatered downwardly through the lower wire over the curved deck of the forming shoe in the range of between about 3% to 5% of the total dewatering which occurs in the forming section.

8. The method of claim 7 wherein during the further dewatering step, the web is dewatered upwardly through the upper wire in an amount equal to about 12% of the total dewatering which occurs in the forming section and downwardly through the lower wire over the deck of the forming shoe in an amount equal to about 4% of the total dewatering.

9. The method of claim 1 wherein during the dewatering step which takes place as the web passes over the second forming roll, the web is dewatered upwardly through the upper wire in the range of between about 2% to 4% of the total dewatering which occurs in the forming section.

10. The method of claim 1 wherein of the total dewatering which occurs in the forming section, the web-forming stock is dewatered downwardly through the lower wire in the initial single-wire dewatering zone in an amount in the range of between about 30% to 55% to form the initially formed web, over the sector of the first dewatering forming roll the initially formed web is dewatered upwardly through the upper wire in the range of between about 15% to 30% and downwardly through the lower wire in the range between about 7% to 12%, over the curved deck of the forming shoe the web is dewatered upwardly through the upper wire in the range of between about 9% to 15% and downwardly through the lower wire in the range of between about 3% to 5%, over the sector of the second forming roll the web is dewatered upwardly through the upper wire in the range of between about 2% to 4%, and over a zone of the forming section subsequent to the second forming roll the web is dewatered downwardly in the range of between about 4% to 8%.

11. The method of claim 1 wherein after passing over the sector of the first forming roll and prior to passing over the deck of the forming shoe, the web is substantially dewatered in an amount in the range of between about 55% to 90% of the total dewatering which occurs in the forming section.

* * * * *